US007845783B2

(12) United States Patent
Gervasi et al.

(10) Patent No.: US 7,845,783 B2
(45) **Date of Patent: *Dec. 7, 2010**

(54) PRESSURE ROLLER TWO-LAYER COATING FOR PHASE-CHANGE INK-JET PRINTER FOR DIRECT ON PAPER PRINTING

(75) Inventors: David J Gervasi, Pittsford, NY (US); Santokh S Badesha, Pittsford, NY (US); James E Williams, Penfield, NY (US); Paul J Mcconville, Webster, NY (US); Jignesh P Sheth, Wilsonville, OR (US)

(73) Assignee: Xerox Corporation, Norwalk, CT (US)

( * ) Notice: Subject to any disclaimer, the term of this patent is extended or adjusted under 35 U.S.C. 154(b) by 191 days.

This patent is subject to a terminal disclaimer.

(21) Appl. No.: 12/178,016

(22) Filed: Jul. 23, 2008

(65) Prior Publication Data

US 2010/0020146 A1 Jan. 28, 2010

(51) Int. Cl.
*B41J 2/175* (2006.01)

(52) U.S. Cl. ..... 347/88; 347/103; 347/99

(58) Field of Classification Search ..... 347/103, 347/88, 99

See application file for complete search history.

(56) References Cited

U.S. PATENT DOCUMENTS 5,177,550 A * 1/1993 Uehara et al. ..... 399/339
5,195,430 A 3/1993 Rise
5,212,032 A * 5/1993 Wilson et al. ..... 430/65
5,345,863 A 9/1994 Kurata et al.
5,389,958 A 2/1995 Bui et al.
5,406,315 A 4/1995 Allen et al.
5,502,476 A 3/1996 Neal et al.
5,777,650 A 7/1998 Blank
5,793,398 A 8/1998 Hennig
5,808,645 A 9/1998 Reeves et al.
6,113,231 A 9/2000 Burr et al.
6,361,230 B1 3/2002 Crystal et al.
6,485,140 B1 11/2002 Lidke et al.
6,494,570 B1 12/2002 Snyder
2003/0235838 A1 12/2003 Keating et al.
2006/0038869 A1 2/2006 Pan et al.
2006/0238586 A1 10/2006 Kohne et al.
2010/0020148 A1* 1/2010 Gervasi et al. ..... 347/99

* cited by examiner

*Primary Examiner*—Matthew Luu
*Assistant Examiner*—Rut Patel
(74) *Attorney, Agent, or Firm*—Pillsbury Winthrop Shaw Pittman LLP

(57) ABSTRACT

A printing apparatus having a) a printing station including at least one printhead for applying phase-change ink to a print substrate in a phase-change ink image, and b) an ink spreading station including an ink spreading member and a back-up pressure member in pressure contact with the ink spreading member forming a nip between the ink spreading member and pressure member for spreading the phase-change ink image on the print substrate, wherein the print substrate is passed through the nip, and wherein the pressure member includes i) a pressure member substrate, and having thereon ii) an intermediate coating comprising a polyurethane material, and having thereon, iii) an outer coating comprising a nitrile butadiene and a conductive filler.

21 Claims, 7 Drawing Sheets

PRESSURE ROLLER TWO-LAYER COATING FOR PHASE-CHANGE INK-JET PRINTER FOR DIRECT ON PAPER PRINTING

CROSS REFERENCE TO RELATED APPLICATIONS

Attention is directed to U.S. application Ser. No. 12/177,952, filed Jul. 23, 2008, entitled "Phase Change Ink Imaging Component Having Conductive Coating;" U.S. application Ser. No. 12/177,965, filed Jul. 23, 2008, entitled, "Electrically Conductive Pressure Roll Surfaces for Phase-Change Ink-Jet Printer for Direct on Paper Printing;" U.S. application Ser. No. 12/177,987, filed Jul. 23, 2008, entitled, "Phase Change Ink Imaging Component Having Two-Layer Configuration." The subject matter of these applications is hereby incorporated by reference in their entireties.

BACKGROUND

The present disclosure relates to ink-jet printing, particularly involving phase-change ink printing directly on a substrate, wherein the substrate can be a substantially continuous web or can be a substrate such as paper or cut paper. In embodiments, the printing apparatus includes an ink spreader station having an ink spreader member, which may be heated, and a back-up pressure member. In embodiments, the pressure member of the ink spreader/pressure system includes a conductive surface, or surfaces, comprising single or multiple layers of polymers like polyurethanes, silicones, ethylene propylene dienemethylene terpolymer, nitrile butadiene rubber, and the like, and combinations thereof.

In further embodiments, the conductivity in these surface(s) can be imparted by the addition of either ionic salts, electronically conducting particles, or the like, or mixtures thereof.

Ink jet printing involves ejecting ink droplets from orifices in a print head onto a receiving surface to form an image. The image is made up of a grid-like pattern of potential drop locations, commonly referred to as pixels. The resolution of the image is expressed by the number of ink drops or dots per inch (dpi), with common resolutions being 300 dpi and 600 dpi.

Ink-jet printing systems commonly use either a direct printing or offset printing architecture. In a typical direct printing system, ink is ejected from jets in the print head directly onto the final receiving web or substrate such as paper or cut paper. In an offset printing system, the image is formed on an intermediate transfer surface and subsequently transferred to the final receiving web. The intermediate transfer surface may take the form of a liquid layer that is applied to a support surface, such as a drum. The print head jets the ink onto the intermediate transfer surface to form an ink image thereon. Once the ink image has been fully deposited, the final receiving web is then brought into contact with the intermediate transfer surface and the ink image is transferred to the final receiving web.

U.S. Pat. No. 5,389,958 is an example of an indirect or offset printing architecture that uses phase change ink. The ink is applied to an intermediate transfer surface in molten form, having been melted from its solid form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving web, such as a sheet of media, is then fed into the transfer nip and the ink image is transferred to the final receiving web.

U.S. Pat. Nos. 5,777,650; 6,494,570; and 6,113,231 show the application of pressure to ink-jet-printed images. U.S. Pat. Nos. 5,345,863; 5,406,315; 5,793,398; 6,361,230; and 6,485,140 describe continuous-web ink-jet printing systems.

U.S. Pat. No. 5,195,430 discloses a pressure fixing apparatus for ink jet inks having 1) an outer shell of rigid, non-compliant material such as steel, or polymer such as acetal homopolymer or Nylon 6/6, and 2) an underlayer of elastomer material having a hardness of about 30 to 60, or about 50 to 60, which can be polyurethane (VIBRATHANE, or REN:C:O-thane).

U.S. Pat. No. 5,502,476 teaches a pressure roller having a metallic core with elastomer coating such as silicones, urethanes, nitrites, or EPDM, and an intermediate transfer member surface of liquid, which can be water, fluorinated oils, glycol, surfactants, mineral oil, silicone oil, functional oils such as mercapto silicone oils or fluorinated silicone oils or the like, or combinations thereof.

U.S. Pat. No. 5,808,645 discloses a transfer roller having a metallic core with elastomer covering of silicone, urethanes, nitrites, and EPDM.

U.S. Patent Publication No. 20030235838 discloses an offset printing machine having an imaging member with an outer coating that may comprise a polyurethane thermoset.

U.S. Patent Publication No. 20060038869 discloses an offset printing machine having an imaging member with an outer coating that may comprise a polyurethane thermoset.

U.S. Patent Publication No. 20060238586 discloses an offset printing apparatus having a transfix pressure member with a substrate and an outer layer having a polyurethane material and positioned on the substrate, wherein the polyurethane outer layer has a modulus of from about 8 to about 300 Mpa, a thickness of from about 0.3 to about 10 mm, and wherein the pressure exerted at the nip is from about 750 to about 4,000 psi, and wherein the outer layer has a convex crown.

Duplex print quality has been a challenging technology issue in many solid ink jet printers. The currently established approach for improving duplex print quality in conventional solid ink print processes is to slow down the duplex speed. Other software modifications have been used, such as the roll on/roll off transfix roll engage/disengage protocol employed in some machines.

Also, of particular concern with direct-to-paper (or direct-on-web) printing is the potential for gloss patterns (ghosting) to be created when the printed side of the paper contacts the pressure roller during duplex. When the ink comes in contact with the pressure roller, some of the oil that is in the ink from the simplex spreading step, transfers to the pressure roller in the pattern of the image. When the oil patterned pressure roller comes in contact with the ink on the page 1 revolution later, it can create gloss patterns called "ghosting." In the solid ink jet offset process, the transfix roller is oiled via contact with the drum to help minimize this problem. The change in the surface roughness of the ink causing the gloss pattern roller ghosting is believed to be associated with the release or surface properties of the elastomer on the pressure roller or transfix roller. In direct-to-paper processing, there is no contact with the drum since it is a web process.

Accordingly, it is desired to provide a pressure member for use with phase change ink printing machines, including duplex machines and direct-on-paper, direct-on-web, or continuous web machines, which has the ability to assist in the spreading of the direct-on-paper developed print without causing alteration to the previously printed ink that contacts the pressure roll during duplex printing. In particular, it is desired to improve the problem of gloss alterations to the image that can be overall or patterned (ghosting), and ink offset to the pressure roll surface, which can be re-deposited back onto the paper/web. It is desired that the pressure roller maintain the functional properties required for roll performance, while satisfying the electrical conductivity or static dissipation requirements. It is also desired that the pressure member, when heated, be thermally stable when heated to the operating temperature. Moreover, it is desired to provide a pressure roller that is wear-resistant, has consistent mechanical properties under high load, resists adhesion of ink, and is conductive.

SUMMARY

Included herein, in embodiments, is a printing apparatus, comprising a) a printing station including at least one printhead for applying phase-change ink to a print substrate in a phase-change ink image, and b) an ink spreading station comprising an ink spreading member and a back-up pressure member in pressure contact with the ink spreading member forming a nip between the ink spreading member and pressure member for spreading the phase-change ink image on the print substrate, wherein the print substrate is passed through the nip, and wherein the pressure member comprises i) a pressure member substrate, and having thereon, ii) an intermediate coating comprising a polyurethane material, and having thereon, iii) an outer coating comprising a nitrile butadiene and a conductive filler.

Embodiments further include a printing apparatus, comprising printing apparatus, comprising a) a printing station including at least one printhead for applying phase-change ink to a print substrate in a phase-change ink image, and b) an ink spreading station comprising an ink spreading member and a back-up pressure member in pressure contact with the ink spreading member forming a nip between the ink spreading member and pressure member for spreading the phase-change ink image on the print substrate, wherein the print substrate is passed through the nip, wherein the pressure exerted at the nip is from about 900 to about 1,200 psi, and wherein the pressure member comprises i) a pressure member substrate, and thereover, ii) an intermediate layer comprising a polyurethane material, and thereover, iii) an outer coating comprising a nitrile butadiene and a carbon black filler, wherein the outer layer has an electrical conductivity of from about $10^3$ to about $10^8$ ohm-cm.

In addition, embodiments include a printing apparatus, comprising a) a printing station including at least one printhead for applying phase-change ink to a print substrate in a phase-change ink image, and b) an ink spreading station comprising an ink spreading member and a back-up pressure member in pressure contact with the ink spreading member forming a nip between the ink spreading member and pressure member for spreading the phase-change ink image on the print substrate, wherein the print substrate is passed through the nip, and wherein the pressure member comprises i) a pressure member substrate, and having thereon ii) an intermediate coating comprising a polyurethane material, and having thereon, iii) an outer coating comprising a nitrile butadiene and a conductive filler.

BRIEF DESCRIPTION OF THE DRAWING

The above embodiments will become apparent as the following description proceeds upon reference to the drawings, which include the following figures.

DETAILED DESCRIPTION

The outer layer herein when applied to the pressure member is electrically conductive. The pressure member outer layer materials herein in direct-to-paper solid ink jet pressure member applications, in embodiments, exhibits increased wear and desired electrical conductivity. The pressure member outer layer materials, in embodiments, allow for enhanced control of oil levels on pressure members in solid ink jet printing applications. The electrical conductivity built in by the filled conductive pressure member outer layer materials, in embodiments, reduces duplex roller ghosting even when the roller is dry. The rollers, in embodiments, remove the need for an additional oil maintenance unit on the spreader pressure roller by eliminating the surface charge buildup on the roller surface. The outer layer, in embodiments, provides increased wear and reduced surface adhesion, and also has the desired electrical conductivity for reduction in ghosting.

Figure 1:
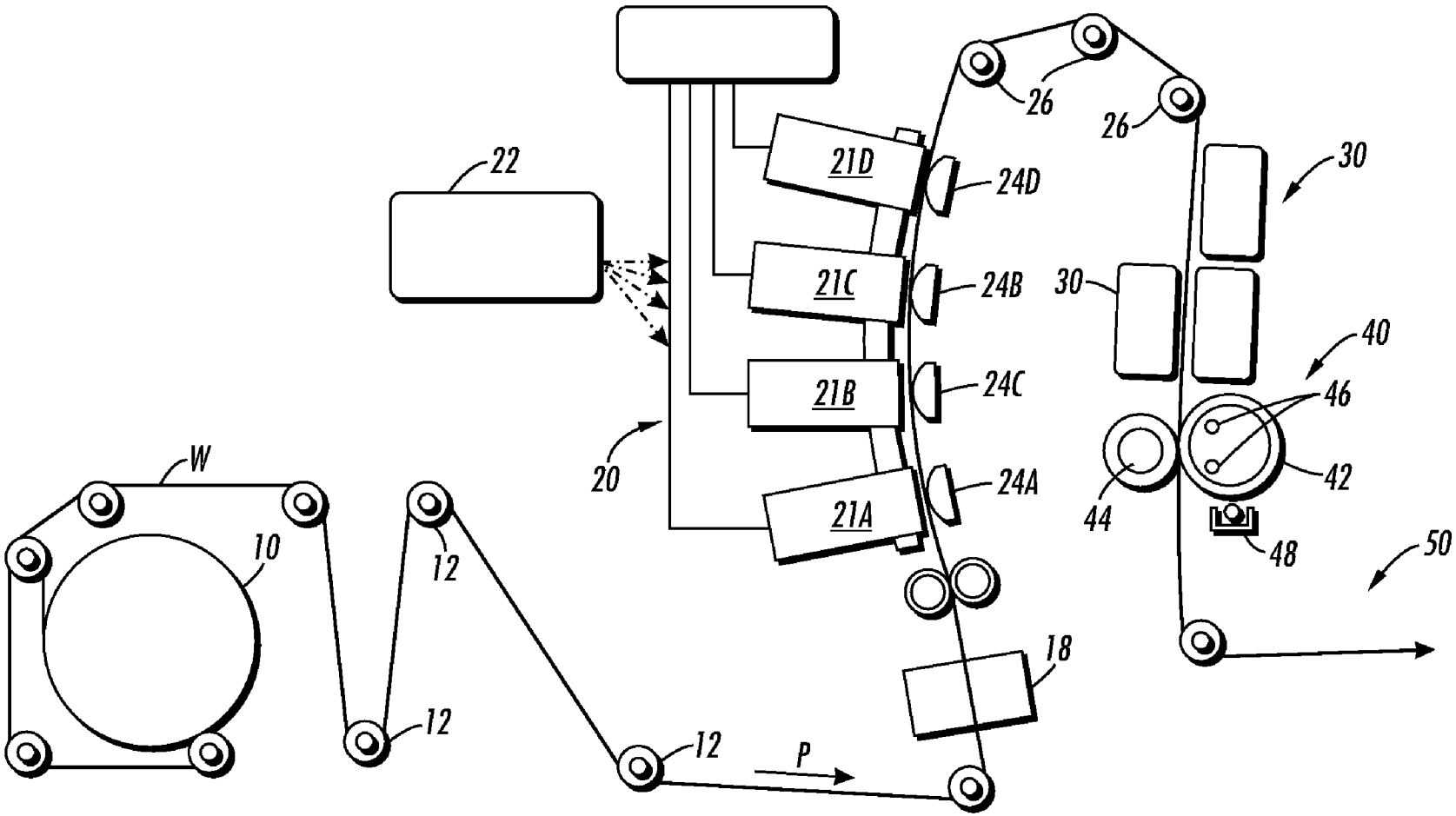
FIG. 1 is a simplified elevational view of a direct-to-sheet, continuous-web, phase-change ink jet printer.

FIG. 1 is a simplified elevational view of a direct-to-sheet, continuous-web, phase-change ink printer. A very long (i.e., substantially continuous) web W of "substrate" (paper, plastic, or other printable material), supplied on a spool 10, is unwound as needed, propelled by a variety of motors, not shown. A set of rolls 12 controls the tension of the unwinding web as the web moves through a path.

Along the path there is provided a preheater 18, which brings the web to an initial predetermined temperature. The preheater 18 can rely on contact, radiant, conductive, or convective heat to bring the web W to a target preheat temperature, in one practical embodiment, of about 30° C. to about 70° C.

The web W moves through a printing station 20 including a series of printheads 21A, 21B, 21C, and 21D, each printhead effectively extending across the width of the web and being able to place ink of one primary color directly (i.e., without use of an intermediate or offset member) onto the moving web. As is generally familiar, each of the four primary-color images (e.g., cyan, magenta, yellow and black, or other suitable colors) placed on overlapping areas on the web W combine to form a full-color image, based on the image data sent to each printhead through image path 22. In various possible embodiments, there may be provided multiple printheads for each primary color; the printheads can each be formed into a single linear array; the function of each color printhead can be divided among multiple distinct printheads located at different locations along the process direction; or the printheads or portions thereof can be mounted movably in a direction transverse to the process direction P, such as for spot-color applications.

The ink directed to web W in this embodiment is a "phase-change ink," by which is meant that the ink is substantially solid at room temperature and substantially liquid when initially jetted onto the web W. Currently-common phase-change inks are typically heated to about 100° C. to about 140° C., and thus in liquid phase, upon being jetted onto the web W. Generally speaking, the liquid ink cools down quickly upon hitting the web W.

Associated with each primary color printhead is a backing member 24A, 24B, 24C, 24D, typically in the form of a bar or roll, which is arranged substantially opposite the printhead on the other side of web W. Each backing member is used to position the web W so that the gap between the printhead and the sheet stays at a known, constant distance. Each backing member can be controlled to cause the adjacent portion of the web to reach a predetermined "ink-receiving" temperature, in one practical embodiment, of about 40° C. to about 60° C. In various possible embodiments, each backing member can include heating elements, cavities for the flow of liquids, etc.; alternatively, the "member" can be in the form of a flow of air or other gas against or near a portion of the web W. The combined actions of preheater 18 plus backing members 24 held to a particular target temperature effectively maintains the web W in the printing zone 20 in a predetermined temperature range of about 45° C. to about 65° C.

As the partially-imaged web moves to receive inks of various colors throughout the printing station 20, it is required that the temperature of the web be maintained to within a given range. Ink is jetted at a temperature typically significantly higher than the receiving web's temperature and thus will heat the surrounding paper (or whatever substance the web W is made of). Therefore, the members in contact with or near the web in zone 20 must be adjusted so that desired web temperature is maintained. For example, although the backing members will have an effect on the web temperature, the air temperature and air flow rate behind and in front of the web will also impact the web temperature and thus must be considered when controlling the web temperature, and thus the web temperature could be affected by utilizing air blowers or fans behind the web in printing station 20.

Thus, the web temperature is kept substantially uniform for the jetting of all inks from printheads in the printing zone 20. This uniformity is valuable for maintaining image quality, and particularly valuable for maintaining constant ink lateral spread (i.e., across the width of web W, such as perpendicular to process direction P) and constant ink penetration of the web. Depending on the thermal properties of the particular inks and the web, this web temperature uniformity may be achieved by preheating the web and using uncontrolled backer members, and/or by controlling the different backer members 24A, 24B, 24C, 24D to different temperatures to keep the substrate temperature substantially constant throughout the printing station. Temperature sensors (not shown) associated with the web W may be used with a control system to achieve this purpose, as well as systems for measuring or inferring (from the image data, for example) how much ink of a given primary color from a printhead is being applied to the web W at a given time. The various backer members can be controlled individually, using input data from the printhead adjacent thereto, as well as from other printheads in the printing station.

Following the printing zone 20 along the web path is a series of tension rolls 26, followed by one or more "midheaters" 30. The midheater 30 can use contact, radiant, conductive, and/or convective heat to bring the web W to the target temperature. The midheater 30 brings the ink placed on the web to a temperature suitable for desired properties when the ink on the web is sent through the ink spreader 40. In one embodiment, a useful range for a target temperature for the midheater is about 35° C. to about 80° C. The midheater 30 has the effect of equalizing the ink and substrate temperatures to within about 15° C. of each other. Lower ink temperature gives less line spread while higher ink temperature causes show-through (visibility of the image from the other side of the print). The midheater 30 adjusts substrate and ink temperatures to 0° C. to 20° C. above the temperature of the ink spreader, which will be described below.

Following the midheaters 30, along the path of web W, is an "ink spreader" 40, that applies a predetermined pressure, and in some implementations, heat, to the web W. The function of the ink spreader 40 is to take what are essentially isolated droplets of ink on web W and smear them out to make a continuous layer by pressure, and, in one embodiment, heat, so that spaces between adjacent drops are filled and image solids become uniform. In addition to spreading the ink, the ink spreader 40 may also improve image permanence by increasing ink layer cohesion and/or increasing the ink-web adhesion. The ink spreader 40 includes rolls, such as image-side roll 42 and pressure roll 44, that apply heat and pressure to the web W. Either roll can include heat elements such as 46 to bring the web W to a temperature in a range from about 35° C. to about 80° C.

In one practical embodiment, the roll temperature in the ink spreader 40 is maintained at about 55° C.; generally, a lower roll temperature gives less line spread while a higher temperature causes imperfections in the gloss. A roll temperature higher than about 57° C. causes ink to offset to the roll. In one practical embodiment, the nip pressure is set in a range of about 750 to about 4,000 psi, or from about 800 to about 4,000 psi, or from about 900 to about 4,000 psi, or from about 1,100 to about 4,000 psi, or from about 900 to about 1,200 psi. Lower nip pressure gives less line spread while higher may reduce pressure roll life.

The ink spreader 40 can also include a cleaning/oiling station 48 associated with image-side roll 42, suitable for cleaning and/or applying a layer of some lubricant or other material to the roll surface. Such a station coats the surface of the ink spreader roll with a lubricant such as amino silicone oil having viscosity of about 10-200 centipoises. Other silicone functional and non-functional oils with identical viscosities can also be used for this purpose. Only small amounts of oil are required and the oil carry out by web W is only about 1-20 mg per A4 size page.

In one possible embodiment, the midheater 30 and ink spreader 40 can be combined within a single unit, with their respective functions occurring relative to the same portion of web W simultaneously.

In the ink spreader 40, the image side roll 42 contacting the inked side of the web is typically reasonably hard, such as being made of anodized aluminum. For the pressure roll 44, a relatively softer roll is used, with a durometer anywhere from about 50 D to about 65 D, with elastic modulii from about 65 MPa to about 115 MPa, and may include a thin elastomer overcoat. In various practical applications, elastomeric or rubbery pressure rolls of one or more layers, with effective elastic modulii from about 50 MPa to about 200 MPa, can be provided.

In a practical implementation, detailed and independent control of the respective temperatures associated with ink spreader 40 (by a control system, not shown) enables gloss adjustment given particular operating conditions and desired print attributes.

It will be recognized by those experienced in the art that the temperatures and pressures effective for spreading an ink of a given formulation will depend on the ink's specific thermal properties. If solvent- or water-based inks were used (i.e., not phase-change ink) in the given implementation, the ink would not necessarily land on the media as a drop but will generally spread out on its own and thus form a smooth layer, rendering, for example, the effect of the ink spreader 40 and other elements uncertain. Similarly, teachings involving placement of dye or inks on a substantially porous substrate such as woven or knit fabric are not necessarily applicable to the present disclosure, as, for instance, the use of an ink spreader such as 40 on cloth is likely to cause ink to be pushed through the cloth. For this and other reasons, many teachings relating to the application of solvent- or water-based inks to webs of various types are not applicable to the present discussion.

Following passage through the ink spreader 40, the printed web can be imaged on the other side, and then cut into pages, such as for binding (not shown). Although printing on a substantially continuous web is shown in the embodiment, the pressure member can be applied to a cut-sheet system as well. Different preheat, midheat and ink spreader temperature setpoints can be selected for different types and weights of web media.

Figure 2:
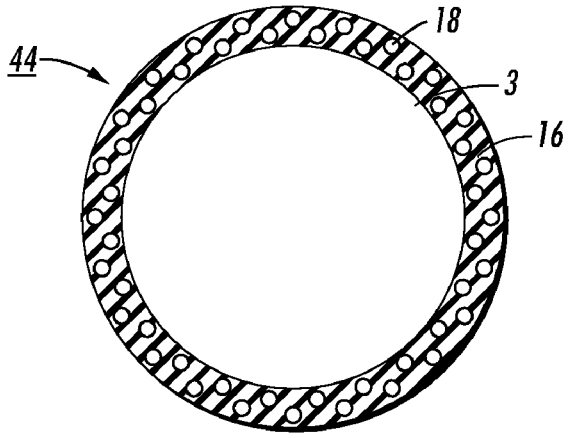
FIG. 2 is an enlarged view of an embodiment of a pressure drum having a substrate and an outer composite layer thereon.

FIG. 2 demonstrates a single layer embodiment herein, wherein pressure member 44 comprises substrate 3, having there over outer coating 16.

Figure 3:
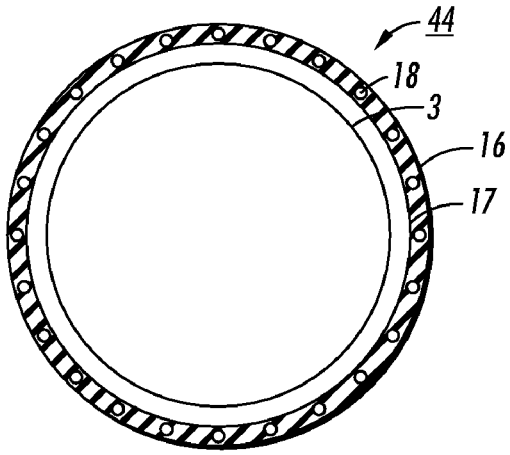
FIG. 3 is an enlarged view of an embodiment of a pressure drum having a substrate, and optional intermediate layer, and an outer composite layer thereon.

FIG. 3 depicts a dual-layer embodiment herein, wherein the pressure member comprises a substrate 3, intermediate layer 17 positioned on the substrate 3, and outer layer 16 positioned on the intermediate layer 17. If the substrate is included, this configuration is sometimes referred to as a three-layer configuration.

In one embodiment, the pressure member 44 includes an outer layer 16. Outer layer 16 comprises a polyurethane and conductive salt, such as an ionically conductive salt.

In the two-layer (sometimes referred to as three-layer) configuration, there is a substrate, an intermediate layer thereon, and an outer layer on the intermediate layer.

Examples of suitable layers for the two-layer configuration include rubber, polyurethane, silicone materials, nitrile rubber, fluoroelastomers, EPDM, and the like.

In embodiments, the outer layer material comprises a nitrile butadiene rubber. Acrylonitrile butadiene rubber (NBR) is a family of unsaturated copolymers of 2-propenenitrile and various butadiene monomers (1,2-butadiene and 1,3-butadiene). The physical and chemical properties vary depending on the polymer's composition of acrylonitrile (the more acrylonitrile within the polymer, the higher the resistance to oils, but the lower the flexibility of the material).

Examples of suitable commercially available nitrile butadiene rubbers include Nipol grades DN003, 1001LG, 1001CG, 1092-80, 1094-80 from Zeon Chemicals; and Therban grades C4367, A4304VP, AT5008VP, AT5005VP, AT5065VP, and HTVPKA8805 available from Lanxess.

The intermediate layer may comprises urethane or polyurethane materials. Examples of suitable polyurethanes include polysiloxane-based polyurethanes fluoropolymer-based urethanes, polyester-based polyurethanes polyether-based polyurethanes and polycaprolactone-based polyurethanes, available from Uniroyal, Bayer, Conap, and the like.

There may be included in the intermediate layer and/or outer layer, fillers, such as electrically conductive fillers. The electrical conductivity is built in by adding electronically conducting particulate fillers, such as carbon fillers, metal oxide filler, polymer fillers, and the like. Examples of carbon filers include carbon black, carbon nanotubes, fluorinated carbon black, graphite and the like. Examples of metal oxides include tin oxide, indium oxide, indium tin oxide, and the like. Examples of polymer fillers include polyanilines, polyacetylenes, polyphenylenes polypyrroles, and the like. The term "electrically conductive particulate fillers" refers to the fillers which have intrinsic electrical conductivity. These can be added to a polymer matrix to impact electrical conductivity. Further improvement of the surface coating can be realized with the addition of particulate fluoropolymers such as polytetrafluoroethylene (PTFE), perfluoroalkoxy substituted fluoropolymers (PFA) or fluorinated ethylene propylene (FEP) and the like. Mixtures of these fluoropolymer additives may also be used.

In embodiments, the outer NBR layer includes a carbon filler, such as carbon black. Commercially available examples include Vulcan 72R, Regal 330, Ketjen Black EC300J, and the like, and mixtures thereof.

The filler is present in the outer layer in an amount of from about 1 to about 50, or from about 5 to about 30, or from about 5 to about 20 percent by weight of total solids in the layer.

The elastomer material is present in the outer coating in an amount of from about 50 to about 99, or from about 70 to about 95, or from about 80 to about 95 percent by weight of total solids.

Also included in the outer coating can be solvents and optional fillers other than the conductive filler, and further the layer can include dispersion agents, co-solvents, surfactants, and the like.

In the two-layer configuration, i.e., an intermediate layer and an outer layer, the thickness of the intermediate layer is from about 1 to about 50 mm, or from about 1 to about 20 mm, or from about 2 to about 10 mm, and the outer layer has a thickness of from about 1 to about 1,000 microns, or from about 25 to about 500 microns, or from about 25 to about 75 microns. In the single layer embodiment, the outer layer thickness is from about 1 to about 50 mm, or from about 1 to about 20 mm, or from about 2 to about 10 mm.

The outer layer of both configurations (one layer or two layers) has an electrical conductivity of from about $10^3$ to about $10^8$ ohm-cm, or from about $10^4$ to about $10^7$ ohm-cm, or from about $10^5$ to about $10^6$ ohm-cm.

The modulus of the outer layer can be from about 8 to about 300 MPa, or from about 8 to about 200 MPa.

The pressure member substrate can comprise any material having suitable strength for use as a pressure member substrate. Examples of suitable materials for the substrate include metals, rubbers, fiberglass composites, and fabrics. Examples of metals include steel, aluminum, nickel, and their alloys, and like metals, and alloys of like metals. The thickness of the substrate can be set appropriate to the type of imaging member employed. In embodiments wherein the substrate is a belt, film, sheet or the like, the thickness can be from about 0.5 to about 500 mils, or from about 1 to about 250 mils. In embodiments wherein the substrate is in the form of a drum, the thickness can be from about 1/32 to about 1 inch, or from about 1/16 to about 5/8 inch.

Examples of suitable pressure substrates include a sheet, a film, a web, a foil, a strip, a coil, a cylinder, a drum, an endless strip, a circular disc, a belt including an endless belt, an endless seamed flexible belt, an endless seamless flexible belt, an endless belt having a puzzle cut seam, a weldable seam, and the like.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The following Examples further define and describe embodiments herein. Unless otherwise indicated, all parts and percentages are by weight.

EXAMPLES

Example 1

Preparation of a Transfix Pressure Member Having Two Layers

A carbon steel core having an inner diameter of 44.5 mm, an outer diameter of 66.2 mm, and a length of 445 mm from Northwest Machine Works of Canby, Oreg., was degreased and cleaned by known methods. A primer layer of 0.002 inches was spray coated onto this core. A polyester based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient was found to be 199 MPa, which did not change more than 36.7 percent when tested up to 72° C. and did not change more than 23.1 percent when tested at 50° C. The intermediate layer was cast by a flow coating method. The layer was then machined to uniform thickness by grinding. The thickness of the layer was 1.5 mm.

The outer layer was then profile ground to achieve a convex radius of 200 meters.

Example 2

Preparation of Pressure Member with an Electronically Conducting Overcoat

Figure 4:
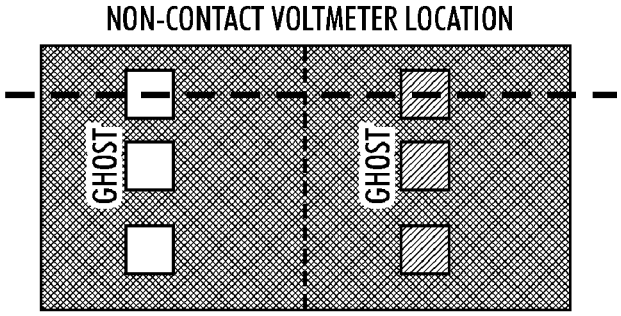
FIG. 4 is a print showing how roller ghosting manifests itself on the duplex image as well as the physical location of a non-contact voltmeter measuring the surface potential of the roll surface.
Figure 5:
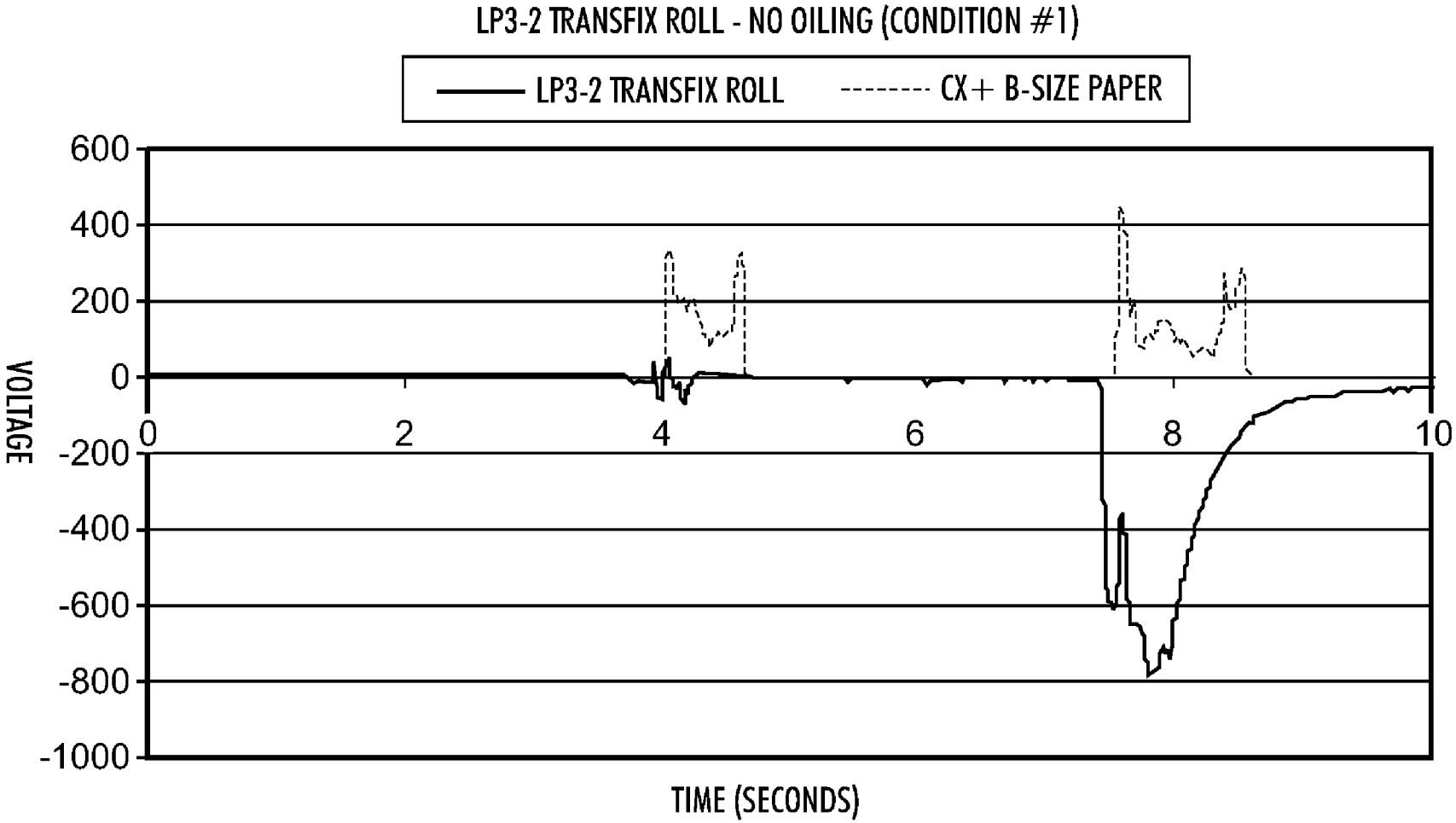
FIG. 5 is a graph of voltage versus time and demonstrates the surface potential for one complete duplex print in the solid ink jet process.
Figure 6:
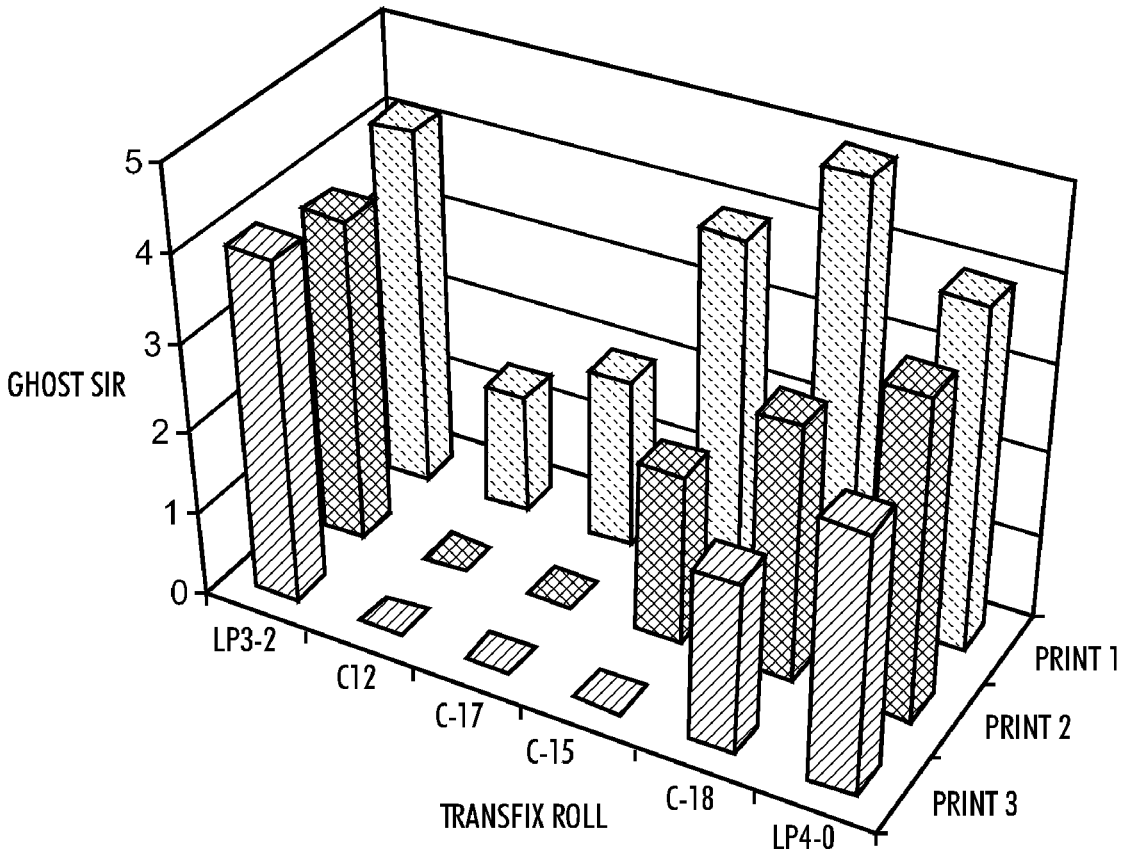
FIG. 6 is a bar graph showing ghosting performance versus print number for different pressure rolls which include non-conductive and conductive surfaces.
Figure 7A:
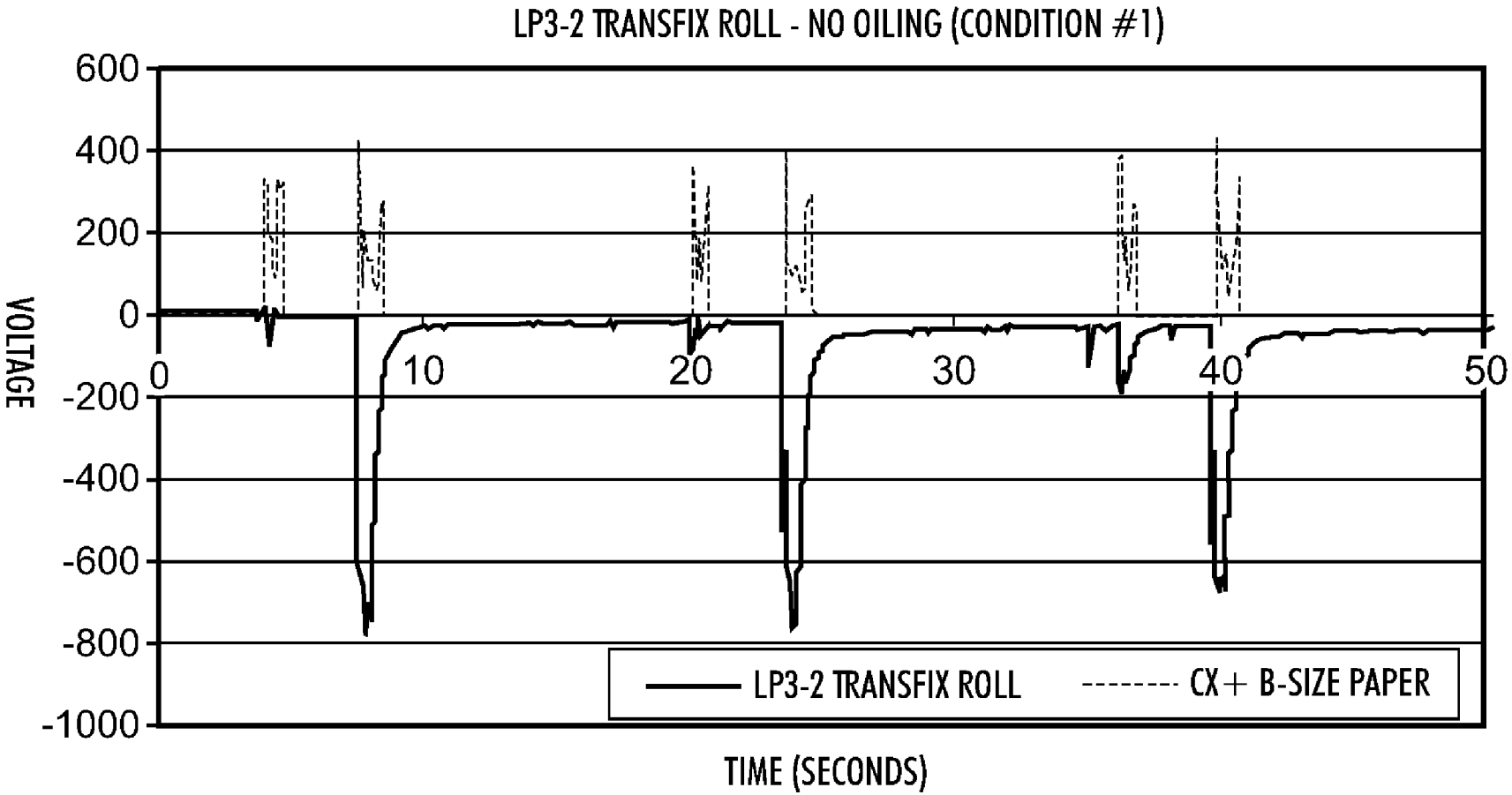
FIG. 7*a* shows roll surface voltage versus time for the standard non-conductive roll and FIG. 7*b* shows roll surface voltage versus time for a conductive roll.
Figure 7B:
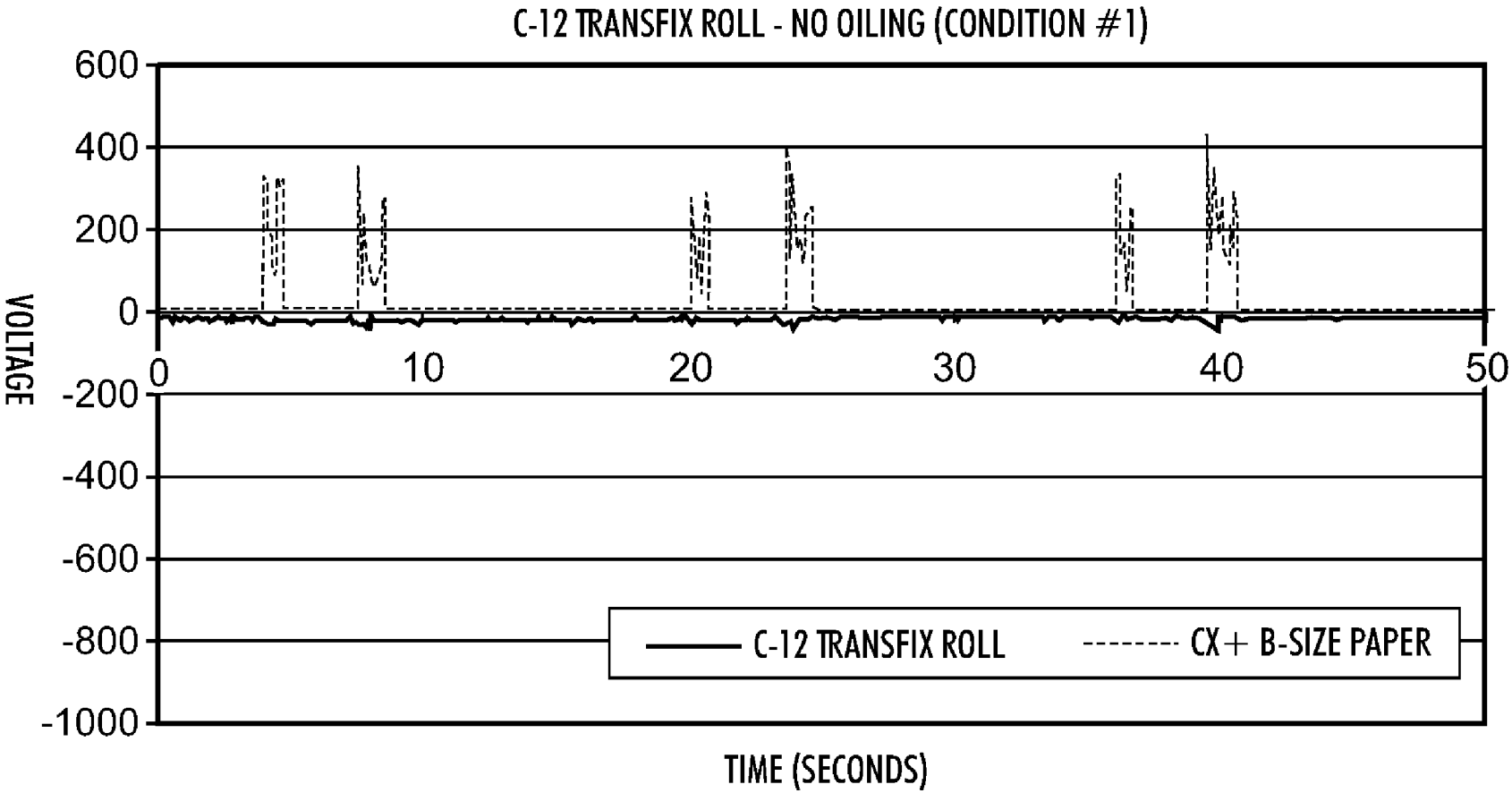

Polyurethane rollers were made to have a conductive surface layer by applying a high carbon filled coating on the surface. These rollers were tested against the standard non-conductive urethane rollers using standard procedures. FIG. 4 shows the manifestation of the gloss ghost, a common defect, and the dotted line represents where on the pressure roll the surface voltage is measured. FIG. 5 shows the pressure roll surface voltage versus time for the standard non-conductive roller. The figure shows gloss ghosting while printing in duplex, by demonstrating the results of testing of Lp3-2 (non-conducting rollers). FIG. 6 includes data for pressure rolls C-12 and C-17, having conductive surfaces, and demonstrates that the gloss ghost is minimized when compared to standard non-conductive rolls (Lp3). The C-15 roller comprises polyurethane one-layer configuration with a fluoropolymer filler. Roller C-18 is a non-conductive roller. The Lp4-0 roller is a standard production roller. FIG. 7*b* demonstrates that the surface voltage versus time for pressure roll C-12 is essentially zero for the conductive surface versus several hundred volts. FIG. 7*a* demonstrates the high ghosting of Lp3-2 non-conducting roller, versus the low-ghosting shown in FIG. 7*b* for conducting rollers C-12. These figures demonstrate the effectiveness of a conductive surface.

Example 3

Preparation of Pressure Member having a Hybrid Configuration of Polyester-Based Polyurethane Underlayer and Electronically Conductive NBR A carbon steel core having an inner diameter of 44.5 mm, an outer diameter of 66.2 mm, and a length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C., and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer comprising of nitrile butadiene rubber (NBR) and either 15% or 35% carbon black by weight, were molded by known procedures. The thickness of the outer layer was determined to be about 0.4 mm. The mechanical property testing of the sample buttons standard ASTM test protocol from this material would indicate the elastic modulus to be about 15 MPa at ambient temperature. The material showed approximately uniform modulus across temperatures to 75° C. The outer layer was then profile ground to achieve a convex radius of about 200 meters.

Figure 8:
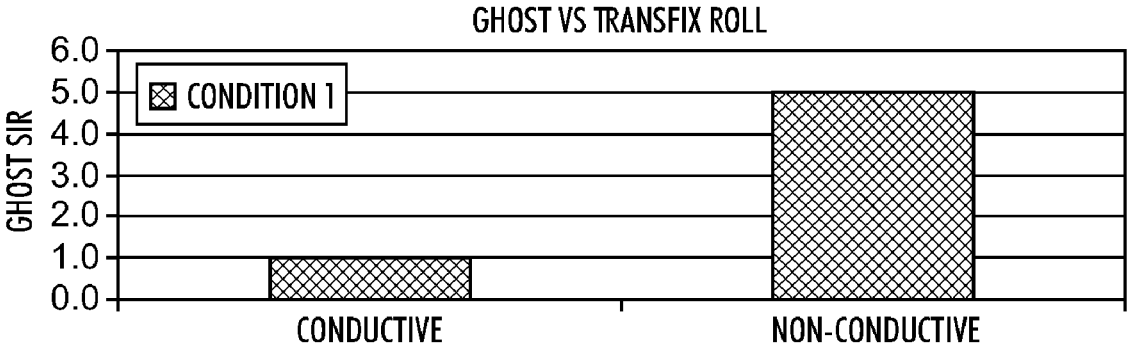
FIG. 8 is a graph showing differences in ghosting performance for non-conductive and conductive rolls.

This roll when installed in a printing test fixture, which applied about a 1,500 to about 2,000 pound load, resulted in a pressure at the nip of from about 800 to about 1,200 psi. The roll on print testing demonstrated acceptable print quality performance as measured by standard metrics and in comparison to previous solid ink products. FIG. 8 shows minimized gloss ghost of a conductive roller as compared to a non-conductive polyurethane.

Example 4

Preparation of Pressure Member having Ionically Conductive Polyurethane for the Transfix Process A carbon steel core having an inner diameter of 44.5 mm, an outer diameter of 66.2 mm, and length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C., and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer was flow coated with a polyester-based polyurethane prepared by a similar reaction of an isocyanate end-capped prepolymer with a functional crosslinking agent in the presence of an appropriate catalyst, with the exception that 1% and 5% by weight of a transition metal salt was added. The thickness of the outer layer was determined to be about 0.4 mm. The mechanical property testing of the sample buttons standard ASTM test protocol from this material would indicate the elastic modulus to be about 17 MPa at ambient temperature. The material showed approximately uniform modulus across temperature to 75° C. The outer layer was then profile ground to achieve a convex radius of 200 meters.

This roll when installed in a printing test fixture, which applied about a 1,500 to about 2,000 pound load resulting in about a pressure at the nip of from about 800 to about 1,200 psi. The roll on print testing demonstrated acceptable print quality performance as measured by standard metrics and in comparison to previous solid ink products.

Example 5

Preparation of Pressure Member having Electronically Conductive Polyurethane for the Transfix Process A carbon steel core having an inner diameter of 44.5 mm, an outer diameter of 66.2 mm, and length of 445 mm from Northwest Machine Works of Canby, Oreg., was degreased and cleaned by known methods. A primer layer of 0.002 inches was spray coated onto this core. A polyester-based polyurethane composition was prepared by reacting an isocyanate end-capped prepolymer with a functional crosslinking agent in the presence of an appropriate catalyst. Test specimens were prepared for mechanical property testing according to standard test protocol. The elastic modulus at ambient temperature was found to be 199 MPa, which did not change more than 36.7 percent when tested up to 72° C. and did not change more than 23.1 percent when tested at 50° C. The intermediate layer was cast by a flow coating method. The layer was then machined to uniform thickness by grinding. The thickness of the layer was 1.5 mm.

The machined layer was then primed and a conductive outer layer was flow coated with a polyester-based polyurethane prepared by a similar reaction of an isocyanate end-capped prepolymer with a functional crosslinking agent in the presence of an appropriate catalyst with the exception that 15% and 25% by weight of carbon black was added. The thickness of the outer layer was determined to be about 0.4 mm. The mechanical property testing of the sample buttons standard ASTM test protocol from this material would indicate the elastic modulus to be about 17 MPa at ambient temperature. The material would show approximately uniform modulus across temperature to 75° C. The outer layer was then profile ground to achieve a convex radius of 200 meters.

This roll when installed in a printing test fixture, which applied about a 1,500 to about 2,000 pound load resulting in about a pressure at the nip of from about 800 to about 1,200 psi. The roll on print testing demonstrated superior print quality performance as measured by standard metrics and in comparison to previous solid ink products.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A printing apparatus, comprising:

a) a printing station including at least one printhead for applying phase-change ink to a print substrate in a phase-change ink image, and b) an ink spreading station comprising an ink spreading member and a back-up pressure member in pressure contact with said ink spreading member forming a nip between said ink spreading member and pressure member for spreading the phase-change ink image on the print substrate, wherein said print substrate is passed through said nip, and wherein said pressure member comprises i) a pressure member substrate, and having thereon ii) an intermediate coating comprising a polyurethane material, and having thereon, iii) an outer coating comprising a nitrile butadiene and a conductive filler for reduction of gloss ghost;

wherein said outer layer has an electrical conductivity of from about $10^3$ to about $10^8$ ohm-cm.

2. The printing apparatus of claim 1, wherein said conductive filler is a carbon filler.

3. The printing apparatus of claim 2, wherein said conductive filler is carbon black.

4. The printing apparatus of claim 1, wherein said conductive filler is present in the outer layer in an amount of from about 1 to about 50 percent by weight of total solids.

5. The printing apparatus of claim 1, wherein said conductive filler is present in the outer layer in an amount of from about 5 to about 30 percent by weight of total solids.

6. The printing apparatus of claim 1, wherein said polyurethane is selected from the group consisting of polysiloxane-based polyurethanes, fluoropolymer-based urethanes, polyester-based polyurethanes, polyether-based polyurethanes, and polycaprolactone-based polyurethanes.

7. The printing apparatus of claim 1, wherein said electrical conductivity is from about $10^4$ to about $10^7$ ohm-cm.

8. The printing apparatus of claim 1, wherein said outer layer has a thickness of from about 1 to about 1,000 microns.

9. The printing apparatus of claim 1, wherein said intermediate layer has a thickness of from about 1 to about 50 mm.

10. The printing apparatus of claim 9, wherein said intermediate layer has a thickness of from about 1 to about 20 mm.

11. The printing apparatus of claim 1, wherein said intermediate layer comprises a conductive filler.

12. The printing apparatus of claim 1, wherein a pressure exerted at said nip is from about 750 to about 4,000 psi.

13. The printing apparatus of claim 12, wherein said pressure exerted at said nip is from about 900 to about 1,200 psi.

14. The printing apparatus of claim 1, wherein said phase change ink is solid at about 25° C.

15. The printing apparatus of claim 1, wherein the print substrate is a substantially continuous web.

16. The printing apparatus of claim 1, wherein the print substrate comprises paper.

17. The printing apparatus of claim 1, further comprising a preheater, disposed upstream from the ink spreading station, for bringing the substrate to a predetermined preheat temperature.

18. The printing apparatus of claim 1, wherein the pressure member is a roller.

19. A printing apparatus, comprising:

a) a printing station including at least one printhead for applying phase-change ink to a print substrate in a phase-change ink image, and b) an ink spreading station comprising an ink spreading member and a back-up pressure member in pressure contact with said ink spreading member forming a nip between said ink spreading member and pressure member for spreading the phase-change ink image on the print substrate, wherein said print substrate is passed through said nip, wherein said pressure exerted at said nip is from about 800 to about 1,200 psi, and wherein said pressure member comprises i) a pressure member substrate, and thereover, ii) an intermediate layer comprising a polyurethane material, and thereover, iii) an outer coating comprising a nitrile butadiene and a carbon black filler for reduction of gloss ghost, wherein said outer layer has an electrical conductivity of from about $10^3$ to about $10^8$ ohm-cm.

20. A printing apparatus, comprising:

a) a printing station including at least one printhead for applying phase-change ink to a print substrate in a phase-change ink image, and b) an ink spreading station comprising an ink spreading member and a back-up pressure member in pressure contact with said ink spreading member forming a nip between said ink spreading member and pressure member for spreading the phase-change ink image on the print substrate, wherein said print substrate is passed through said nip, and wherein said pressure member comprises i) a pressure member substrate, and having thereon ii) an intermediate coating comprising a polyurethane material, and having thereon, iii) an outer coating comprising a nitrile butadiene and a conductive filler for reduction of gloss ghost;

wherein said outer layer has a thickness of from about 25 to about 500 microns and an electrical conductivity of from about $10^3$ to about $10^8$ ohm-cm:

21. A printing apparatus, comprising:

a) a printing station including at least one printhead for applying phase-change ink to a print substrate in a phase-change ink image, and b) an ink spreading station comprising an ink spreading member and a back-up pressure member in pressure contact with said ink spreading member forming a nip between said ink spreading member and pressure member for spreading the phase-change ink image on the print substrate, wherein said print substrate is passed through said nip, wherein said pressure exerted at said nip is from about 800 to about 1,200 psi, and wherein said pressure member comprises i) a pressure member substrate, and thereover, ii) an intermediate layer comprising a polyurethane material, and thereover, iii) an outer coating comprising a nitrile butadiene and a carbon black filler for reduction of gloss ghost, wherein said outer layer has a thickness of from about 25 to about 500 microns and an electrical conductivity of from about $10^3$ to about $10^8$ ohm-cm.

* * * * *